US005532200A

United States Patent [19]

Gundjian

[11] Patent Number: 5,532,200

[45] Date of Patent: Jul. 2, 1996

[54] LATENT IMAGE PRINTING PROCESS AND APPARATUS AND SUBSTRATE THEREFOR

[75] Inventor: Arshavir Gundjian, Montreal, Canada

[73] Assignee: Nocopi International Inc., Wayne, Pa.

[21] Appl. No.: 341,328

[22] Filed: Nov. 16, 1994

Related U.S. Application Data

[63] Continuation of Ser. No. 808,331, Dec. 16, 1991, abandoned, which is a continuation-in-part of Ser. No. 685,575, Apr. 15, 1991, abandoned.

[51] Int. Cl.[6] ..... B41M 5/30; B41M 5/40

[52] U.S. Cl. ..... 503/201; 503/226

[58] Field of Search ..... 503/201, 214, 503/215, 226; 427/152

[56] References Cited

U.S. PATENT DOCUMENTS

| | | | |
|---|---|---|---|
| 3,788,875 | 1/1974 | Schutzner . | |
| 3,906,123 | 9/1975 | Vincent et al. | 427/150 |
| 4,036,511 | 7/1977 | Maalouf | 503/226 |
| 4,760,048 | 7/1988 | Kurihara et al. . | |
| 4,837,584 | 6/1989 | Sharkey et al. . | |

FOREIGN PATENT DOCUMENTS

| | | | |
|---|---|---|---|
| 0252579 | 1/1988 | European Pat. Off. . | |
| 2419634 | 10/1975 | Germany . | |
| 127795 | 7/1984 | Japan | 503/201 |
| 248784 | 11/1986 | Japan | 503/201 |
| 2159967 | 12/1985 | United Kingdom | 428/321.5 |

OTHER PUBLICATIONS

Patent Abstracts Of Japan, vol. 8, No. 120, Jun. 6, 1984.

*Primary Examiner*—B. Hamilton Hess
*Attorney, Agent, or Firm*—Sprung Horn Kramer & Woods

[57] ABSTRACT

A latent image printing method and apparatus uses a substrate with one main surface having a covering comprising one of a first pair of a color developer and color former dye defining a background color in conjunction with the one main surface, wherein the color developer and the color former dye react when mixed to produce a first spectral response which is visible relative to the background color and a continuous coating over the covering which is non-porous with respect to the other of the pair and solvent-resistant to the other of the pair. The coating above selected portions of the covering corresponding to a desired latent image is removed.

11 Claims, 1 Drawing Sheet

LATENT IMAGE PRINTING PROCESS AND APPARATUS AND SUBSTRATE THEREFOR

This application is a continuation of application Ser. No. 07/808,331, filed Dec. 16, 1991, now abandoned, which is a continuation-in-part of application Ser. No. 07/685,575 filed Apr. 15, 1991 and now abandoned.

BACKGROUND OF THE INVENTION

This invention relates to a printing method and system whereby the information printed on a substrate, such as paper, is transferred in the form of a latent image or "secure image" which is invisible to the eye and any other usual image detecting device at the time of printing and is revealed only after the substrate is subjected to a subsequent process of image activation. This invention is also interpreted as providing a system whereby the initial process of information printing instantly seals and secures the printed message in a way equivalent to the centuries old process of securing printed information by enclosing a letter in an opaque envelope, without the need of an "envelope". The subsequent process of image activation corresponds to the classical process of "tearing the envelope" to reveal the enclosed message or information.

It is understood of course that over the whole time of the history of printing inks, a search and a fascination for invisible inks has always existed. Many such ink systems have been found, developed and used in a limited way mainly because of the limited accessibility of such invisible inks and delivery systems for the latter.

SUMMARY OF THE INVENTION

The object of this invention is to develop a special composite chemical coating system utilizing presently readily available materials that can be easily applied to a paper or any other substrate in large volume configurations, such that said paper can be utilized in presently widely used machines for telecopying, printing or typing and result in printed invisible information, i.e., "secure information" in a latent image state, hence sealed and secured from the eye and any other viewing and copying device, until it is subjected to a simple image activation process, which "breaks the seal" or the protective veil and reveals the printed message.

A very wide use of this invention is expected to be in the area of telecopiers. Presently it is well acknowledged that a great disadvantage of telecopiers resides in the complete absence of any protection or privacy of messages and documents transmitted by those machines. The present invention provides a most convenient and effective solution to this problem. Indeed when commonly used thermal fax paper is replaced by this novel latent image printing substrate or paper according to the present invention, the received fax information will be transferred to this paper but will remain invisible and therefore sealed and secure until an authorized person subjects the paper to the activation process. Many variations of this basic invention can ,easily be visualized and are all intended to be covered by this invention.

DETAILED DESCRIPTION OF THE INVENTION

As stated above, invisible ink systems have been used for centuries. As is known, a colorless liquid A is used to write on a document which thus results in an invisible text. At the receiving end the traces of the colorless liquid A are revealed or rendered visible by either applying a second or activating liquid B to the paper or, for example, by applying heat depending on the nature of the chemical A.

The present invention can use any one of the known A,B chemical combinations that can act in the manner described above.

In a particularly advantageous embodiment of the invention, it is particularly convenient to utilize the well known combination of any one or a combination of leuco dyes, such as, Copikem-1, otherwise identified as 3,3-Bis(4-dimethylaminophenyl)-6-dimethyl phthalide, from Hilton-Davis Co. of Cincinnati, Ohio, Copikem-4, otherwise identified as 2-Anilino-3-methyl-6-diethyl aminofluoran from Hilton-Davis, and PSD-150, otherwise identified as 3-Cyclohexyl methyl amino-6-methyl-7-Anilinofluoran from Nippon Soda Co. of Tokyo, Japan, widely used in the carbonless or thermal paper industry, acting as chemical A, and any one of the well known corresponding activators or developers such as, zinc chloride, ferric chloride anc Novalac resins such as HRJ-4002 and HRJ-2609 from Schenectady Chemicals of Albany, N.Y., acting as chemical B.

Figure 1:
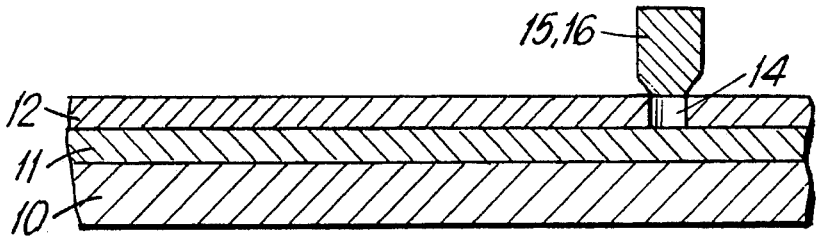
FIG. 1 is a cross sectional view of a substrate in accordance with the present invention in use with a latent image process and apparatus according to the invention.

The chemical A or B is then coated onto a substrate such as mylar, paper or the like. A specific substrate such as particularly a paper sheet substrate 10 shown in FIG. 1 is coated with a first film 11 which consists of the chemical A or B blended in an appropriate binder which provides a good adhesion of the film 11 onto the substrate 10.

Next a second thin film 12 is laid down on the film 11. The film 12 is specified to have a number of critical properties, as follows:

1. The thin film 12 must provide a continuous i.e. non-porous impermeable protective covering to film 11 such that any liquid and particularly the carrier for the complementary chemical B or A (see below) applied on film 12 shall not be allowed to mechanically penetrate it and hence reach coating 11.
2. The thin film 12 must be solvent resistant, particularly to the specific solvent used for the complementary chemical B or A which shall be used as the activating agent at the stage where the latent image is to be revealed depending on whether chemical A or B is utilized in the layer 11 of the composite coating structure.
3. The thin film 12 has a low melting point $T_m$ of the order of 100° C., that is from 50° to 200° C., preferably 50° to 150° C., more preferably 60° to 110° C. and most preferably from 65° to 95° C., such that upon local application of heat by thermal printing element 15 on thin film 12 as the temperature reaches $T_m$, the coating "melts" and opens a window 14 in thin film 12 which now will allow the penetration of a liquid, such as specifically the activating agent carrying solvent referred to above, when the latter is applied onto the surface of the substrate.

4. The thin film 12 has a thickness which is sufficiently thin, of the order of a micron, that is 0.1 to 10μ, more preferably 0.1 to 3μand most preferably 0.1 to 1μ, such that a mechanical pressure applied locally, with a pencil- or pen-like device as well as the head 16 of an impact printer such as a typewriter, will easily break it and open a window 14.

Figure 2A:
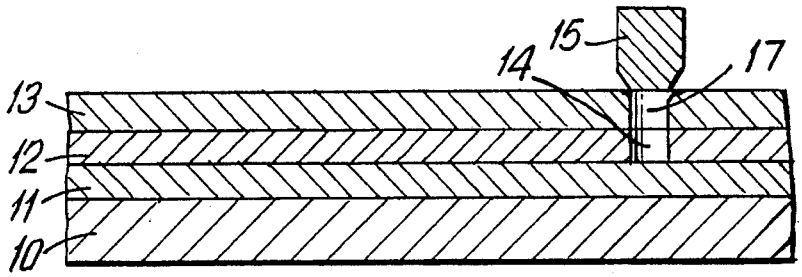
FIGS. 2*a* and 2*b* are cross sectional views of alternative embodiments according to the present invention.
Figure 2B:
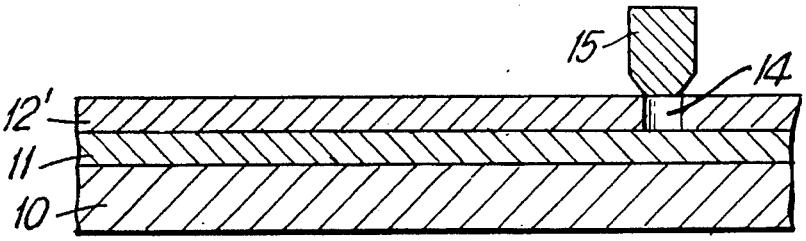

When the composite coating system according to the present invention is predetermined to be utilized in applications uniquely related to telecopiers (i.e. fax machines), the addition of another constituent may be desirable as shown in FIGS. 2*a* and 2*b*. The film 12 is thus overcoated with a film 13 consisting of a commercially known sensitizer commonly used in the thermal paper industry, for example, dibenzoyl terephthalate (DBT) from Nippon Soda Co. of Tokyo, Japan, paraffin wax and wax blends from Amoco, Ind., USA. Such sensitizers have the property of being in an inert solid state at room temperature. Upon heating to up to a critical temperature $T_c$ of the order of 100° C. under the telecopier head, the sensitizer melts at 17 and acts as a solvent which is intended here to help further with the opening of the window 14 in film 12 as described above. This requires of course that film 13 act as a solvent for film 12 which otherwise is specified to be resistent to the specific solvents used for the activating agent as described above. It is also possible to combine films 12 and 13 into a single composite protective and heat sensitive film 12' as shown in FIG. 2*b*.

Figure 3:
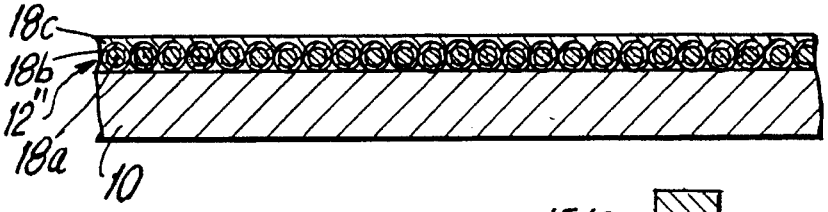
FIG. 3 is a cross sectional view of another embodiment of the present invention.

In yet another embodiment shown in FIG. 3 the chemical A or B is laid down as film 12" composed of microcapsules 18 utilizing the widely known technology of microencapsulation with the capsule walls playing the role of the film 12 and hence having to comply with the requirements placed on 12 as described above and chemical A or B in microcapsules 18 acting as layer 11.

The latent image printing substrate is prepared by coating a paper web 10 having a white background, with the layer 12" comprising a mixture containing microencapsulated leucodye 18*a* encapsulated in wax 18*b* and integrated with wax 18*c* to a thickness of two microns.

The web then be wound on a roll and placed in a fax machine. The fax machine imprints the text on the wax coating while breaking the capsules and exposing the leucodyes. This forms the latent image.

The latent image, the text, is then developed by applying a developer by means of a roller impregnated therewith.

The latent image printing process and apparatus according to the invention for generating a latent image invisible to the eye and other document reading devices, will now be described in connection with a substrate coated following the prescriptions set forth above.

In any embodiment described above it is possible that the invisible printing process which generates indentations in layers 12, 12', 12" or 13 in FIGS. 1, 2*a*, 2*b* and 3 will result in a trace that under hard scrutiny is visible to the eye. It is, therefore, proposed that the surface of the substrate 10 or the film 11, 12 12', 12" or 13 of FIGS. 1, 2*a*, 2*b* or 3 be overprinted with a very lightly visible "scrambler" pattern which does not interfere to any appreciable extent with the reading process but hides most conveniently any eventual trace of indentations.

1. Printing in a Telecopier or Fax machine

At the receiving end of a fax transmission system, the signals received by the fax machine are converted into heat, in machines that use thermal fax paper, at the tips of the printing matrix of the machine which then is applied on the well known thermal fax paper that rolls under this matrix. At the heated spots where the temperature is raised to around 100° C., the sensitizer particles melt and act as a solvent simultaneously to leucodye and developer particles (i.e. a combination of A & B chemicals described above), thus A and B mix and a color is developed.

In accordance with the present invention, the thermal paper is replaced by the new secure printing paper or substrate described above. It is clear that the printing matrix of the fax machine when activated by an incoming signal to print a document, acts in the way illustrated in FIGS. 1 and 2, thus merely opening tiny windows 14,17 on the paper surface where a character is expected to be printed. Clearly at these locations an open passage is now available towards the layer 11 which is made of only one of either chemical A or B, i.e., for example either a leucodye or a developer as described above.

The paper that comes out of the fax machine will thus remain as clear of any visible traces as when it entered the machine.

2. Printing via an impact printer

It is easily visualized that when the secure printing paper is placed in any one of the known types of impact printers such as a typewriter, the impact pressure from the head of the printer along the profile of the character to be printed will break the coating 12 and consequently will create a tiny window 17 offering free passage from the surface of the sheet to layer 11.

It is thus understood that in any of the cases described above the printed document carries the text in the form of exposed portions of the layer 11. Such text is, however, colorless and therefore invisible to the eye or other image detecting devices.

Activation of the text is carried out simply by applying to the printed surface of the "secure printing substrate" the complimentary B or A chemical carrying solvent, by any convenient method. Upon such application it is clear that this solvent will penetrate into the windows 14,17 previously described and will dissolve the primary chemical A or B in layer 11. The mixing of A or B with B or A will produce a visible color, and hence the latent image of the text will become visible and readable.

The activating agent can be applied typically utilizing a marker pen structure such as described in the pending patent application PCTCA9000203 filed Jun. 29, 1990. It can also be applied through a convenient pad impregnated with the activating agent which then is swept over the substrate. Alternatively, the substrate is manually or mechanically pressed onto such a pad and pushed under it to activate the text.

In addition to the above, other advantageous embodiments of the secure printing process are considered for impact printers, thermal printers and thermal telecopiers and copies.

Figure 4:
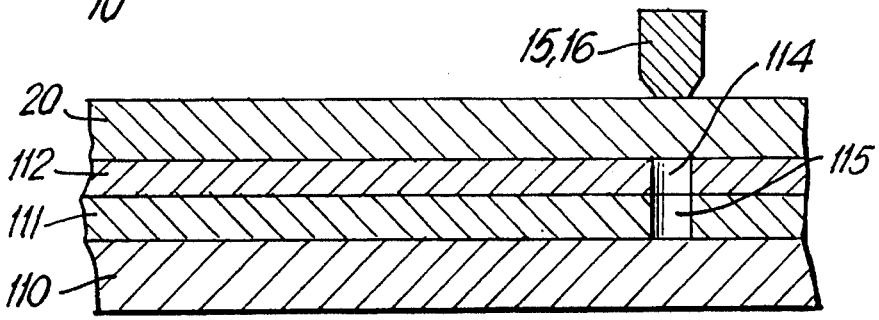
FIGS. 4 and 5 are cross sectional views of other embodiments of the invention.

When utilizing a thermal printer (or any thermal printing device) or an impact printer which is carrying a commonly used printing ribbon, a preferably thin caliper sheet of paper 20, as shown in FIG. 4, is superposed on the "secure substrate" 110 carrying first film 111 and second film 112 such that the printing element 15, 16 directly contacts the regular paper 20. The regular paper 20 preferably has a thickness of 25 microns. The pressure or heat is clearly still transferred to the layer 112 on the sheet 110 and the expected process is achieved, because area 114 of layer 112 will crack off or melt and adhere to paper 20. There is also the advantage in this case of generating spontaneously a visible original of the printed text on the inserted ordinary top sheet 20 when an impact printer is used with a ribbon.

Alternatively, the coating 111 can be made to be easily transferrable from substrate 110, as in Example 6, so that for the case of a thermal printer or fax, both area 114 of layer 112 and an area 115 of layer 111 will transfer to sheet 20 as a result of the application of localized heat.

Figure 5:
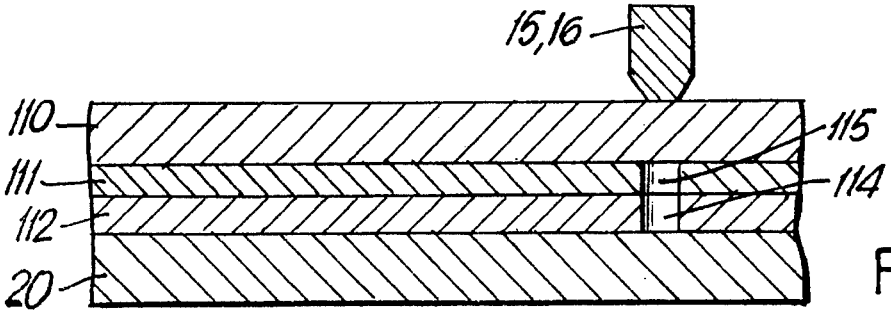

It is also found that the secure printing paper sheet or substrate role can be reversed as shown in FIG. 5. The secure printing substrate 110 is now used as the top surface of a pair where the second sheet 20 is an ordinary paper, such that the coating 111,112 faces the second sheet 20. In this case, the substrate 110 is preferably thin, on the order of 25 microns. The printing element 15,16 contacts the back of sheet 110 from behind the composite coating 111,112, and still causes the layer 112 to break or melt along the pressure profile and transfers area 114 of layer 112 onto the ordinary paper 20 along the profile of the printed characters.

Alternatively, the coating 111 can be made to be easily transferrable from substrate 110 (as in Example 6), so that both area 114 of layer 112 and area 115 of layer 111 will transfer to sheet 20 as a result of the application of localized heat or pressure. The ordinary paper 20 is now carrying the full text in an invisible manner, and can be activated in a way identical to that described above.

It should be noted that in this case the layer 112 of the composite coating need be very thin, preferably a submicron skin of protection which simply prevents the layer 111 from transferring to a superposed surface unless substantial pressure or heat is applied.

EXAMPLE 1

A latent image printing substrate is prepared by coating a web of 15 pound basis weight paper having a white background with a first colorless layer of Novalac resin HRJ-4002 from Schenectady Chemicals and polyvinyl alcohol acting as a binder and having a thickness of 2 microns. A second colorless layer of acylic copolymer having a thickness of 1 micron and a melting point of 70° C. is continuously coated on the first layer to act as a barrier. A third colorless layer of DBT from Nippon Soda Co. having a thickness of 1 micron and a melting point of 94° C. is coated on the second layer to act as a sensitizer.

The web is wound into a roll and placed in a thermal paper process fax machine Model 2800L from Ricoh Corp. of Japan. A transmission of one page of text is sent to the fax machine. The fax machine records the text on the substrate by heating the coated surface thereof, at points corresponding to the text, to a temperature of about 95° C. which melts the layers of DBT which in turn melts and dissolves the acrylic resin and thus locally removes the same. The fax machine automatically emits one sheet of paper cut from the roll and bearing a latent image of the text which is invisible to the eye.

The latent image is activated by applying the leucodye Copikem-1 in liquid form on the coated surface of the sheet by means of a roller impregnated therewith. The reaction of Copikem-1 and Novalac resin HRJ-4002 in the areas where the DBT and the acrylic copolymer films have been removed results in a color change from colorless, to blue which is visible against the white background.

EXAMPLE 2

A first layer of Copikem-1 and polyvinyl acetate and $TiO_2$ acting as a white coloring agent has a thickness of 2 microns and has white color. The second and third layers are the same as in Example 1.

The latent image is formed as in Example 1, and the image is activated by applying the developer HRJ-2609 in liquid form on the coated surface of the sheet by means of a marker pen impregnated therewith. The reaction of Copikem-1 and HRJ-2609 in the areas where the DBT and acrylic films have been removed results in a color change from white to blue which is visible against the white background of the first layer.

EXAMPLE 3

The second and third layers are integrated into a single layer to avoid double coating and the resulting substrate is used as in Example 2.

EXAMPLE 4

A latent image printing substrate is prepared by coating a sheet of 15 pound weight basis paper having a white background with a first colorless layer of Novalac resin HRJ-4002 and polyvinyl alcohol acting as a binder and having a thickness of 2 microns. A second colorless layer of refined paraffin wax having a thickness of 1 micron and a melting point of 65° C. is continuously coated on the first layer to act as a barrier.

The sheet is placed in a IBM typewriter having a printwheel impact printing element and no ribbon. One page of text is typed on the sheet by impacting the coated surface thereof, at points corresponding to the text, which breaks the film of wax and thus locally removes same. The one sheet of paper bears a latent image of the text which is invisible to the eye.

The latent image is activated by applying Copikem-1 in liquid form on the coated surface of the sheet by means of a roller impregnated therewith. The reaction of HRJ-4002 and Copikem-1 in the areas where the wax film has been removed results in a color change from colorless to blue which is visible against the white background.

EXAMPLE 5

The sheet of Example 4 is used in a fax machine as in Example 1 to produce a latent image and is activated as in Example 4.

EXAMPLE 6

A latent image printing substrate is prepared by continuously coating a first sheet of 15 pound weight basis paper having a white background with an integrated layer having a thickness of 3 microns and a melting point of 65° C. of Novalac resin HRJ-4002 and refined paraffin wax.

The coating of the first sheet is placed against a second sheet of plain white paper and the two are inserted in an IBM typewriter having a printwheel impact printing element and ribbon. One page of text is typed on the uncoated face of the first sheet by impacting the uncoated surface thereof through the ribbon, at points corresponding to the text, which types thereon and breaks the film of wax and resin and thus locally transfers same to the facing surface of the second sheet. The second sheet of paper bears a latent image of the text which is invisible to the eye.

The latent image is activated by applying Copikem-1 in liquid form on the facing surface of the second sheet by means of a roller impregnated therewith. The reaction of HRJ-4002 and Copikem-1 in the areas where the wax film has been transferred results in a color change from colorless to blue which is visible,against the white background.

What is claimed is:

1. A printing process comprising the steps of: providing a first sheet member having one surface with a colorless planar first layer of particles of only one of a pair of a color developer and a color former dye and a colorless continuous planar second shielding layer over the first layer; removably mounting a second sheet member having an uncoated surface on the first sheet member with the uncoated surface adjacent the shielding layer, wherein the uncoated surface of the second sheet member has a background color, wherein particles of said one of the pair are reactable with the other of the pair only when carried in a solvent to produce a spectral response which is visible relative to the background color of the uncoated surface of the second sheet member and wherein the shielding layer has a thickness of 0.1 to 10 microns and a melting point of from 50° to 200° C.; and transferring selected portions of the first and second layers to the uncoated surface of the second sheet member corresponding to a desired latent image by applying heat to one of the first and second sheet members to form the desired latent image on the uncoated surface of the second sheet member which is not visible until activated by the other of the pair carried in the solvent.

2. The process according to claim 1, wherein the first and second sheet members are paper sheets.

3. The process according to claim 1, wherein one of the first and second sheet members has a thickness of about 25 microns.

4. The process according to claim 1, wherein the shielding layer includes a sensitizer.

5. The process according to claims 1, further comprising providing a third layer of a sensitizer on the second layer.

6. The process according to claim 1, further comprising removing the first sheet member from the second sheet member to expose the uncoated surface with the latent image thereon and thereafter activating the latent image to form a visible image by applying the other of said pair carried in the solvent.

7. A latent image printing substrate comprising: a first sheet member having one surface with a colorless planar first layer of particles of only one of a pair of a color developer and a color former dye and a colorless continuous planar second shielding layer over the first layer; a second sheet member having an uncoated surface with a background color and removably mounted on the first sheet member with the uncoated surface adjacent the shielding layer, wherein particles of said one of the pair are reactable with the other of the pair only when carried in a solvent to produce a spectral response which is visible relative to the background color of the uncoated surface of the second sheet member; wherein the shielding layer has a thickness of 0.1 to 10 microns and a melting point of from 50° to 200° C.; and. wherein selected portions of the first and second layers corresponding to a desired latent image are transferable to the uncoated surface of the second sheet member in response to the application of heat to one of the first and second sheet members to form the desired latent image on the uncoated surface of the second sheet member which is not visible until activated by the other of the pair carried in the solvent.

8. The substrate according to claim 7, wherein the first and second sheet members are paper sheets.

9. The substrate according to claim 7, wherein one of the first and second sheet members has a thickness of about 25 microns.

10. The substrate according to claim 7, wherein the shielding layer includes a sensitizer.

11. The substrate according to claim 7, further comprising a third layer of a sensitizer on the second layer.

* * * * *